US006739221B2

(12) United States Patent
Cha

(10) Patent No.: US 6,739,221 B2
(45) Date of Patent: May 25, 2004

(54) POWER DRIVEN WRENCH

(76) Inventor: Sun B. Cha, 14130 Gabrielle Way, Centreville, VA (US) 20121

( * ) Notice: Subject to any disclaimer, the term of this patent is extended or adjusted under 35 U.S.C. 154(b) by 36 days.

(21) Appl. No.: 10/267,801

(22) Filed: Oct. 10, 2002

(65) Prior Publication Data

US 2004/0069096 A1 Apr. 15, 2004

(51) Int. Cl.[7] ..... B25B 21/00
(52) U.S. Cl. ..... 81/57.13; 81/57.14; 81/DIG. 11
(58) Field of Search ..... 81/57.13, 57, 57.11, 81/57.14, 57.29, 57.3, 57.31, DIG. 11, 185

(56) References Cited

U.S. PATENT DOCUMENTS 2,584,172 A * 2/1952 Underwood ..... 81/57.13
3,939,924 A 2/1976 Grabovac
4,179,955 A 12/1979 Akiyoshi et al.
4,287,795 A 9/1981 Curtiss
4,524,649 A * 6/1985 Diaz et al. ..... 81/57.13
4,974,475 A * 12/1990 Lord et al. ..... 81/57.13
5,524,512 A * 6/1996 Wolfe ..... 81/57.14
5,896,789 A * 4/1999 Giardino ..... 81/57.13
6,035,745 A * 3/2000 Kather ..... 81/57.13
6,282,990 B1 9/2001 Miner
6,332,382 B1 * 12/2001 Anderson et al. ..... 81/DIG. 11

* cited by examiner

*Primary Examiner*—D. S. Meislin
(74) *Attorney, Agent, or Firm*—Birch, Stewart, Kolasch & Birch LLP

(57) ABSTRACT

A power driven wrench which comprises a handle housing containing a power source and a motor disposed therein, a motor gear coaxially connected to the motor, a head housing united with said handle housing as a unit, said head housing containing a hexagonal, cutout socket receiving head gear adapted to receive a socket for engaging various types of nuts and bolts. A plurality of gears connecting the motor gear with the head gear, and a plurality of top ball bearing sets and bottom ball bearing sets, which are spring biased to engage a top surface and a bottom surface of the head gear.

7 Claims, 6 Drawing Sheets

POWER DRIVEN WRENCH

BACKGROUND THE INVENTION

1. Field of the Invention

The present invention relates to an improved power driven wrench and more particularly, to a power wrench having a driving power source and a housing with a socket receiving head for tightening and loosening various types of nuts and bolts.

2. Description of Related Art

Various types of power wrenches are well-known in the art. Generally, there is need to provide an impact wrench adapted to be powered for fastening and loosening nuts, bolts and screws in normal and emergency maintenance work around houses and automobiles. For example, while working on automobile maintenance for tightening and loosening the nuts and bolts, the worker spends long hours and much energy to do simple tasks by using conventional ratchet tools. Also, current pistol-style hand held power tools are readily available for tightening screws, and some have an adapter to drive sockets for working with hexagonal nuts and bolts. However, such tools are not useful when working in a tight space such as around the engine compartment of a vehicle or in the case of using a long bolts requiring extended socket length for kitchen sink assembly.

Such power wrenches are shown in U.S. Pat. No. 3,939,924 (Grabovac), and U.S. Pat. No. 4,179,955 (Akiyoshi et al.), as well as U.S. Pat. No. 6,282,990 (Miner). In addition, U.S. Pat. No. 4,287,795 (Curtiss) discloses a blade wrench including an adjustable interconnection disposed between a tool body and a blade portion which permits selective angular positioning of the blade portion of the wrench relative to the tool body.

However, such conventional tools suffer from many problems. For example, the rotary power driver does not include confining spaces in the engine compartment of automobiles and at the same time, does not allow the bolts to pass through the center of a head and socket assembly of the driver to permit the driver to travel along the length of the bolts.

SUMMARY OF THE INVENTION

Accordingly, it is an object of the present invention to provide an improved power driven wrench which eliminates the above problems encountered with conventional power driven nut and bolt drivers.

Another object of the present invention is to provide an electric motor driven tool for working with nuts and bolts, screws, and other fastening devices by means of sockets adapted to drive members configured to drive nuts and the bolts, screws of various types, and drill bits, etc.

A further object of the present invention is to provide an electric impact wrench for working in a confining work space as well as in lengthy bolt fastening applications, without requiring an extender bar in non-confining work space applications.

Still another object of the present invention is to provide hand power tools that are more inexpensive than the conventional hand tools, and which are more useful around the house and garage alike, for home projects or mechanic's application using a socket driver body with sizes up to 13/16 of an inch, or even sizes of from 1 to 2 inches or more.

Yet another object of the present invention is to provide a power driven nut and bolt driver which is simple in structure, inexpensive to manufacture, durable in use, and refined in appearance.

Briefly described, the present invention is directed to a power driven nut and bolt driver for use in tight space and with lengthy bolts because it is relatively flat and uses a cylinder pipe that permits the driver to travel along the length of the bolt. The nut and bolt uses sockets having an opening in one end.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
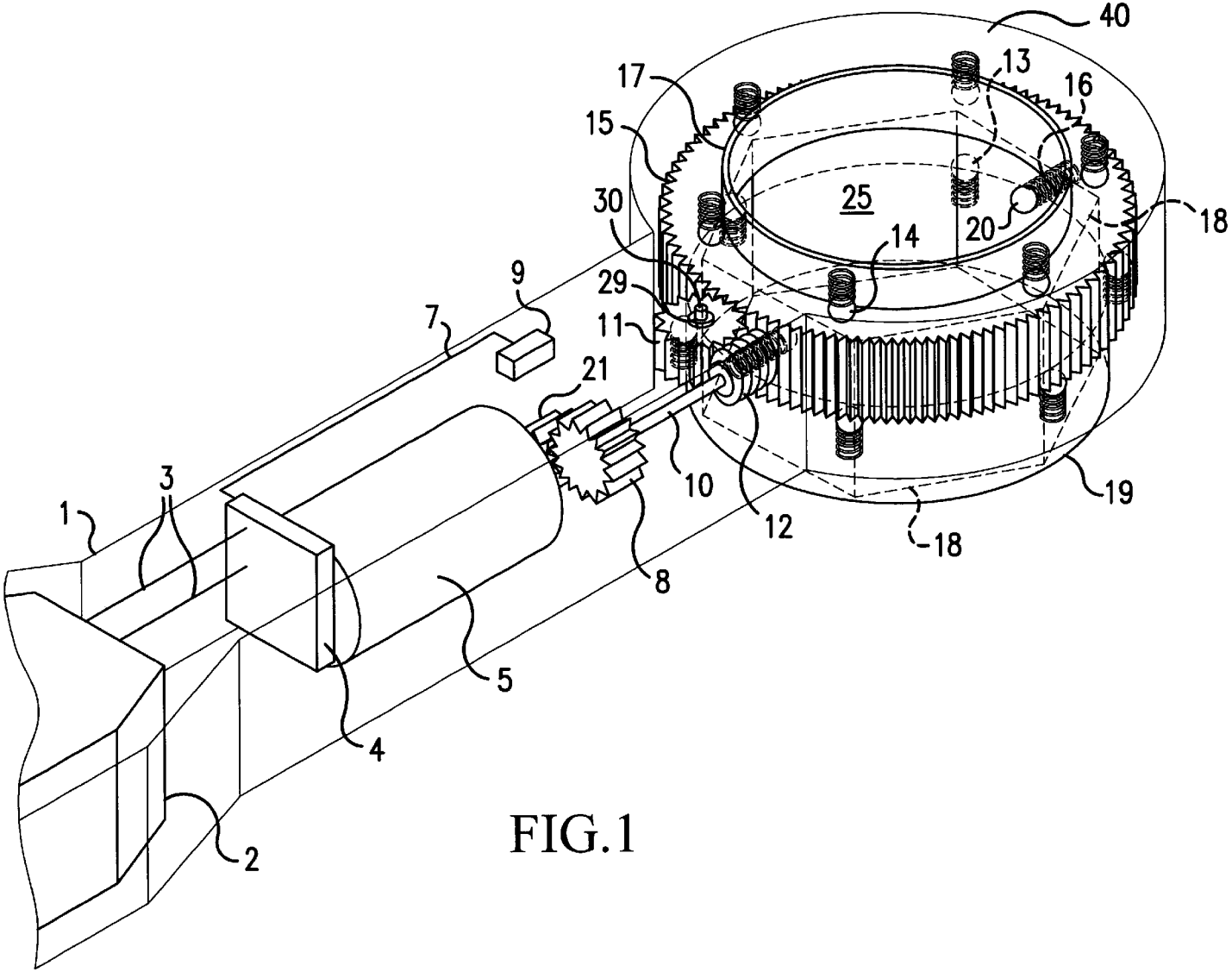
FIG. 1 is a perspective view of a power driven nut and bolt driver according to the present invention.
Figure 2:
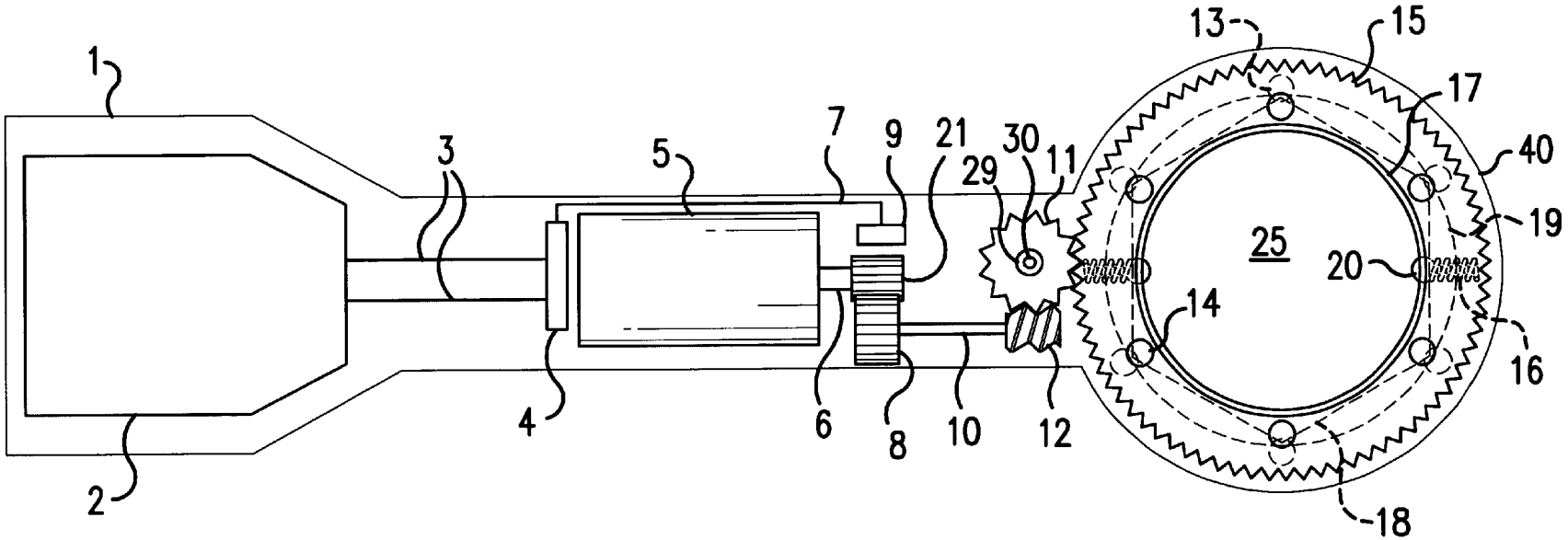
FIG. 2 is a top plan view of the power driven nut and bolt driver according to the present invention.
Figure 3:
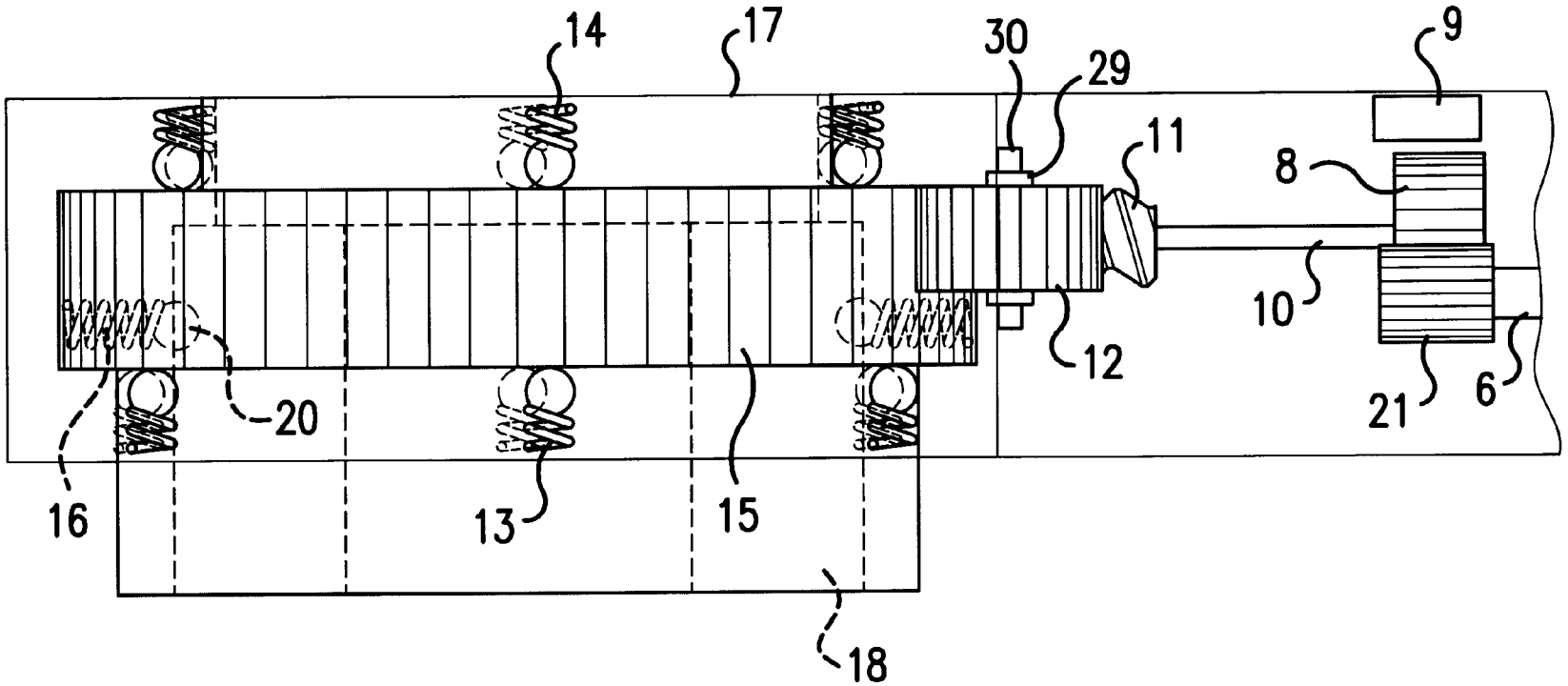
FIG. 3 is a side elevational view of the power driven nut and bolt driver according to the present invention.

Referring now in detail to the drawings for the purpose of illustrating preferred embodiments of the present invention, the power driven nut and bolt driver as shown in FIGS. 1, 2 and 3, includes a handle housing 1 having an electric battery 2, an electric motor 5, and a transmission gear 8 disposed therewithin. A head housing 40 is provided which contains a head gear 15, a hexagonal cutout socket receiver 18, a top cylinder 17, a bottom cylinder 19, and an opening 25 disposed therewithin. Generally, the handle and head housings 1 and 40 are preferably of a flat configuration.

The electric battery 2 is rechargeable and replaceable. The motor 5 is connected to the electric battery 2 by current carrying wires 3 through a circuit board 4, and to a switch button 9 through a wire 7. Also, the motor 5 such as a DC motor is provided with a motor gear 21 mounted on a motor shaft 6 which is rotated by the DC motor 5. The motor gear 21 is in gearing relationship with a transmission gear 8, which is coaxially connected to a transmission output gear 12. Upon rotation of the motor in the clockwise direction, the transmission gear 8 rotates in the counter clockwise direction. Accordingly, the transmission output gear 12 also rotates in the counter clockwise direction whereas a speed reducing gear 11 rotates in the clockwise direction. The speed reducing gear 11 has a gear shaft 30 and an antifriction washer 29.

The electric motor 5 has approximately one-third horsepower or less depending on the size of the workload for the power driven bolt and nut driver of the present invention. However, the electric motor 5 can be energized to a 6, 9, or 12 volt DC. The switch button 9 is positioned as a trigger on the surface of the handle housing 1. When the switch button 9 is set on forward or reverse, the electric motor 5 energized by the battery 2 and the motor shaft 6 for the electric motor 5 rotates.

Figure 4:
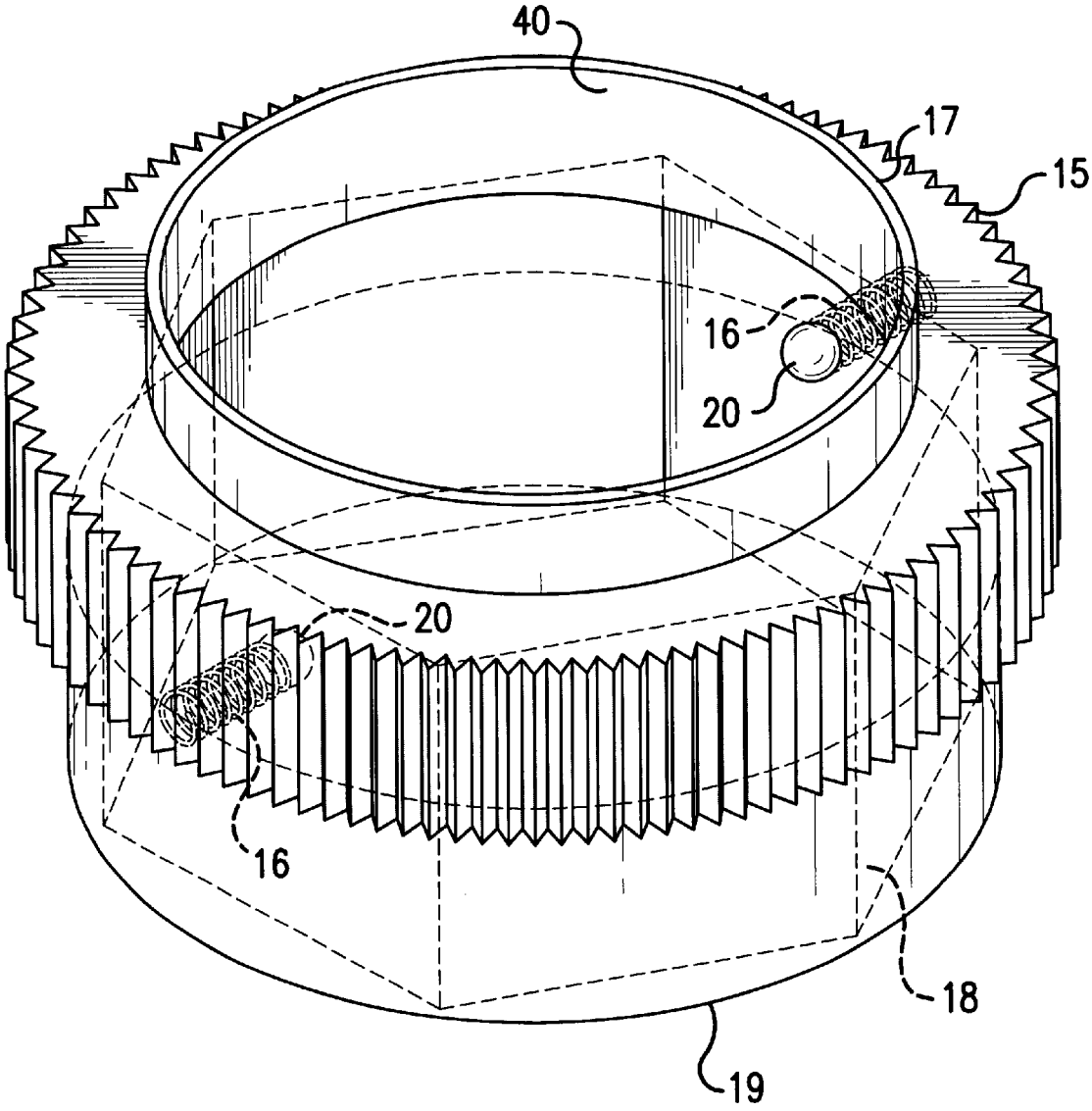
FIG. 4 is an enlarged perspective view of a head housing of the power driven nut and bolt driver according to the present invention.
Figure 5:
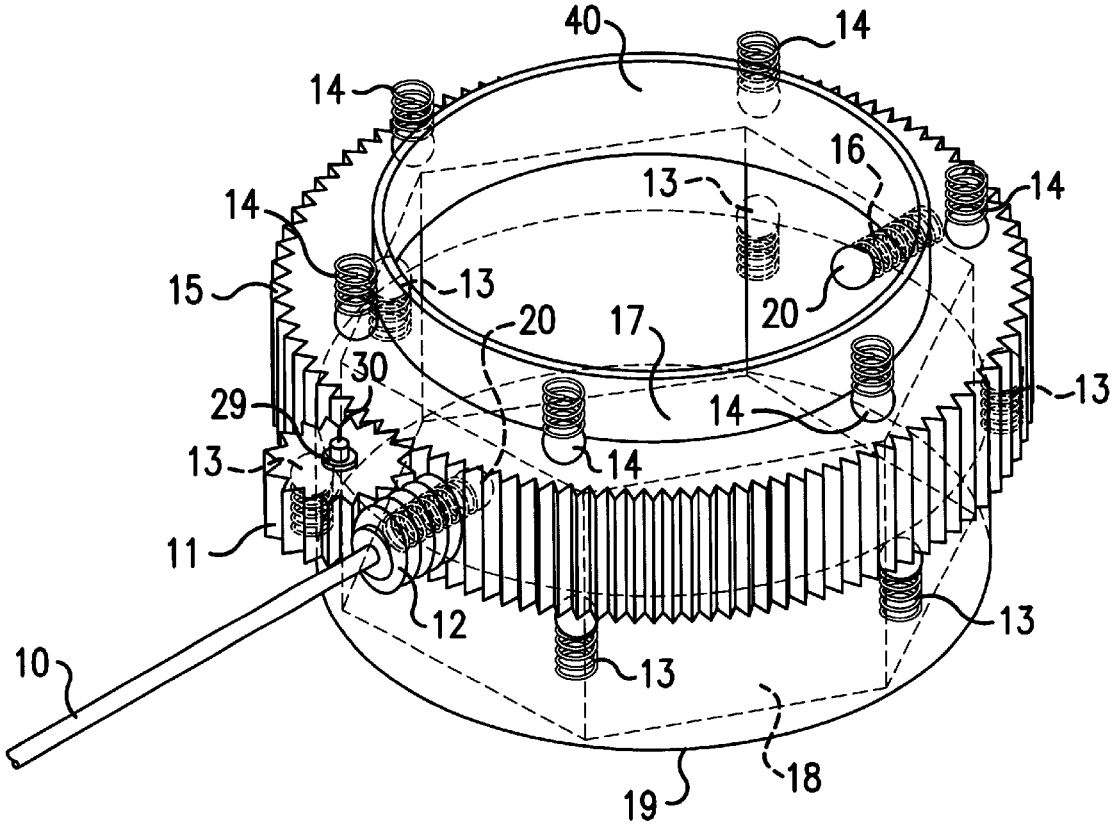
FIG. 5 is a perspective view of the head housing of the power driven nut and bolt driver containing antifriction coated ball bearings disposed therein according to the present invention.

Referring in detail to FIGS. 1, 4 and 5, the head housing 40 includes a head gear 15, an opening 25, a pair of top and bottom cylinders 17 and 19, a pair of bottom and top ball bearing sets 13 and 14, and a pair of socket holding ball bearings 20 disposed in a ball bearing assemble tube 16. When the electric motor 5 rotates in the clockwise direction, the motor shaft 6 drives the transmission gear 8 in the counter clockwise direction. Therefore, the transmission gear 8 drives the head gear 15 in the counter clockwise direction. However, the head gear 15 can rotate in the counter clockwise or clockwise direction depending on the forward or reverse setting of the switch button 9.

Figure 6A:
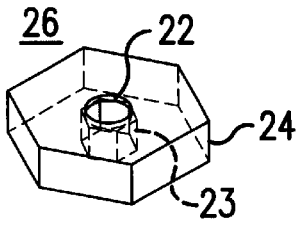
FIGS. 6(A)–6(C) are perspective, top and side views of a hexagonal cutout socket receiver of the driver, respectively according to the present invention.
Figure 7A:
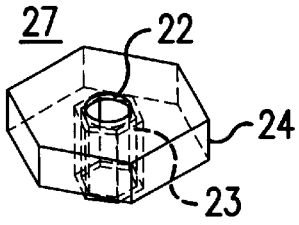
FIGS. 7(A)–7(C) are perspective, top and side views of a hexagonal cutout socket receiver of the driver, respectively according to the present invention.
Figure 8A:
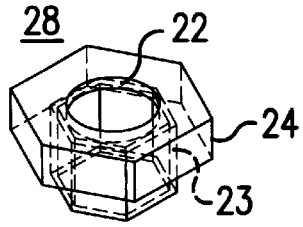
FIGS. 8(A)–8(C) are perspective, side and plan views of a hexagonal cutout socket receiver of the driver, respectively according to the present invention.
Figure 6B:
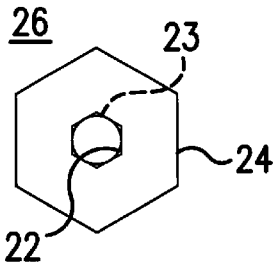
Figure 7B:
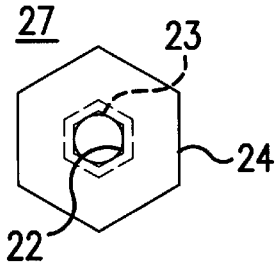
Figure 8B:
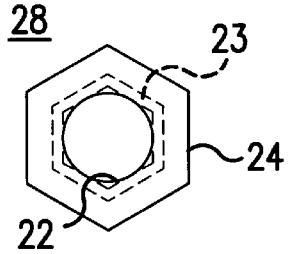
Figure 6C:
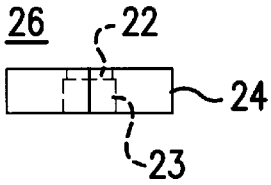
Figure 7C:
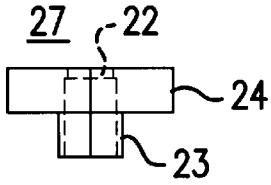
Figure 8C:
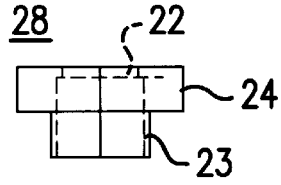

Accordingly, the head housing 40 is a kind of socket receiving member for receiving hexagonal adapter sockets 26, 27 and 28, for rotating driving bits, such as a screwdriver, a nut, or a bolt head, as shown in FIGS. 6(A), 7(A) and 8(A). At this time, the hexagonal adapter sockets 26, 27 and 28 are strongly tightened by a pair of socket holding ball bearings 20. In the case of tightening the nut and the like or the lengthy bolt disposed under the kitchen sink faucet assembly, the power driven nut and bolt driver according to the present invention, can be used to drive the nut, following the length of the bolt, as the bolt extends through the opening 25 of the head housing 40.

Referring in detail to FIGS. 6(A)–8(C), a hexagonal end of a standard nut and bolt head can be fitted to the inside of a nut and bolt receiver 23 of sockets 26 and 27. The sockets 27 and 28 show a size of hexagonal cutout having a center opening for a driving bit such as the screwdriver, nut or bolt head. The size of the hexagonal cutout socket receiver 18 of the driver of the present invention, can vary from 3/16 to 13/16 inch for around the house and automobile applications. Also, the power driven nut and bolt driver according to the present invention can be made in larger dimensions to work with 1 to 2 inch or more if need for industrial applications. The numerals 22 is a cylinder block and 24 is a hexagonal socket head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power driven wrench which comprises:

a handle housing containing a power source and a motor disposed therein;

a motor gear coaxially connected to the motor;

a head housing united with said handle housing as a unit, said head housing containing a hexagonal, cutout socket receiving head gear adapted to receive a socket for engaging various types of nuts and bolts;

a plurality of gears connecting the motor gear with the head gear; and a plurality of top ball bearing sets and bottom ball bearing sets, which are spring biased to engage a top surface and a bottom surface of the head gear.

2. The power driven wrench of claim 1, wherein said plurality of gears includes:

a transmission gear in a gearing relationship with said motor gear; and a transmission output gear coaxially connected to said transmission gear.

3. The power driven wrench of claim 2, wherein said plurality of gears further includes:

a speed reducing gear in gearing relationship with said transmission output gear and with said head gear of the head housing, whereby the head gear containing the hexagonal cutout socket receiver can rotate in the counter clockwise or in the clockwise direction depending on the setting of a switch button operatively connected to the motor.

4. The power driven wrench of claim 3, wherein the speed reducing gear is provided with an antifriction washer an a speed reducing gear shaft.

5. The power driven wrench of claim 1, wherein said socket receiving head has a size of 3/16 to 13/16 inch.

6. The power driven wrench of claim 1, wherein the power source is a motor.

7. The power driven wrench of claim 1, wherein a plurality of ball bearing sets are spring biased for lateral engagement within the head gear.

* * * * *